US005084967A

United States Patent [19]

Nakagawa et al.

[11] Patent Number: 5,084,967

[45] Date of Patent: Feb. 4, 1992

[54] DRY SHAVER WITH A TRIMMER

[75] Inventors: Hisao, Nakagawa, Biwa; Shinsaku Yasunaka; Masato Morita, both of Hikone, all of Japan

[73] Assignee: Matsushita Electric Works, Ltd., Osaka, Japan

[21] Appl. No.: 733,993

[22] Filed: Jul. 22, 1991

[30] Foreign Application Priority Data

Jul. 31, 1990 [JP] Japan ..... 2-204319

[51] Int. Cl.[5] ..... B26B 19/06

[52] U.S. Cl. ..... 30/34.1

[58] Field of Search ..... 30/34.1, 34.9, 200

[56] References Cited

U.S. PATENT DOCUMENTS

| | | | |
|---|---|---|---|
| 4,283,848 | 8/1981 | Messinger et al. | 30/34.1 |
| 4,426,776 | 1/1984 | Kakumoto et al. | 30/34.1 |
| 4,845,847 | 7/1989 | Yasunaka et al. | 30/34.1 |
| 4,926,552 | 5/1990 | Otsuka et al. . | |
| 4,934,553 | 3/1984 | Kness | 30/34.1 |
| 5,022,153 | 6/1991 | Baron | 30/34.1 |

FOREIGN PATENT DOCUMENTS 3111871 1/1982 Fed. Rep. of Germany .

*Primary Examiner*—Douglas D. Watts

*Assistant Examiner*—Paul M Heyrana, Sr.

*Attorney, Agent, or Firm*—Stevens, Davis, Miller & Mosher

[57] ABSTRACT

A dry shaver has a trimmer plate with a trimmer cutter at its upper end. The trimmer plate is slidably mounted on a vertically elongated front face of a shaver housing with the trimmer cutter projecting forwardly of the housing. The trimmer plate is pivotally connected at its lower end to a slider handle also slidable on the front face such that the trimmer plate is vertically movable together therewith along the front face between a lower inoperative position where it is kept lain flat against the front face and an upper operative position where it is pivoted into an inclined condition with respect to the front face so as to project the trimmer cutter forwardly by a greater distance from the front face than at the lower inoperative position. An improvement resides in that the trimmer plate is allowed to pivot towards the front face of the housing when it is in the upper operative position and is spring-biased into the inclined condition so that the trimmer plate can be retracted towards the shaver housing against the spring-bias while urging the trimmer cutter into intimate and constant contact with the skin for increased convenience of cutting the hairs.

5 Claims, 15 Drawing Sheets

DRY SHAVER WITH A TRIMMER

BACKGROUND OF THE INVENTION

1. Field of the Invention

The present invention is directed to a dry shaver with a trimmer, and more particularly a dry shaver with a pivotable trimmer.

2. Description of the Prior Art

In the prior dry shavers, there have been incorporated generally two type of trimmers, namely, slidable type and pivotable type, as schematically shown in FIGS. 17 and 18, respectively. In a slidable type, the trimmer comprises a trimmer plate 60A slidably mounted on a shaver housing 10A to be vertically movable therealong between a lower inoperative position and an upper operative position where a trimmer cutter 62A projects in an adjacent relation to a main cutter 20A. In a pivotable type, the trimmer comprises a trimmer plate 60B pivoted at its one end to an upper end of a shaver housing 10B adjacent a main cutter 20B to be movable between an inoperative position where it lies flat against the front face of the housing 10B and an operative position where it pivots at about a right angle to the front face for projecting a trimmer cutter 62B outwardly away from the main cutter 20B. The slidable-type trimmer is found to be advantageous in trimming hairs on the underside of the chin as the main cutter 20A gives less hindrance to the trimming operation, shown in FIG. 19. On the other hand, the pivotable-type trimmer is advantageous in trimming sideburns since the main cutter 20B can be well spaced from the trimmer cutter 62B so as not to be in touch with an ear, as shown in FIG. 20. However, the slidable-type trimmer and the pivotable-type trimmer are rather inconvenient when trimming the opposite portions, i.e., hairs on the underside of the chin and the sideburns, respectively, in both of which the main cutters 20A and 20B will certainly hamper the movement of the trimmer. In order to alleviate the above inconvenience, German patent publication DE 3 111 871 proposes an inclined-type trimmer in which a trimmer plate is inclined with respect to the front face of a shaver housing when it is moved upwardly into an operative position. Thus, a trimmer cutter at the upper end of the trimmer plate can be located in an adjacent relation to the main cutter in the operative position and project forwardly from the front face of the housing by a distance which is greater than that in the slidable-type trimmer but less than that in the pivotable-type trimmer. Therefore, the trimmer of this patent might can alleviate the above problem and be conveniently handled for trimming the hairs on the underside of the chin as wells as the sideburns. However, there remains another problem in that the skin might be irritated or even injured by the edge of the trimmer cutter when the trimmer cutter is pushed against the skin for close shaving, particularly for hairs on a relatively delicate skin such as on the underside of the chin. With this result, the user should refrain from pushing the trimmer cutter against the skin and therefore fail to achieve desired close shaving.

SUMMARY OF THE INVENTION

The above problems have been eliminated by the present invention which provides a dry shaver with an improved trimmer. The dry shaver in accordance with the present invention comprises a housing mounting a main cutter at its upper end, a slide handle vertically slidable along a vertically elongated front face of the housing, and a trimmer plate carrying a trimmer cutter projecting forwardly from an upper end of the trimmer plate. The trimmer plate is slidably mounted on the front face of the housing and is pivotally connected at its lower end to the slider handle such that the trimmer plate is vertically movable together therewith along the front face between a lower inoperative position where it is kept lain flat against the front face and an upper operative position where it is pivoted into an inclined condition with respect to the front face so as to project the trimmer cutter forwardly by a greater distance from the front face than at the lower inoperative position. An improvement resides in that the trimmer plate is allowed to pivot towards the front face of the housing when it is in the upper operative position and is spring-biased into the inclined condition so that the trimmer plate can be retracted backward against the spring-bias. With this retractable structure of the trimmer, as the trimmer cutter is pushed against the skin the trimmer cutter is retracted by a suitable extent and is urged back therefrom by the spring-bias into intimate and even contact with the skin. Thus, the trimmer cutter can be kept in intimate contact even with irregular skin surface by a suitable pressure and such intimate contact can be kept during the manipulation of following the trimmer cutter over the skin surface, assuring a close shave on intricate skin surface readily without irritating the skin. In other words, an excessive pushing force applied to the trimmer by the user can be absorbed by the retracting movement of the trimmer plate so as to maintain a suitable pressure by the spring-bias at which the trimmer cutter is urged against the skin surface, preventing the skin irritation or injury. This effect is added to the advantages that the trimmer can be conveniently utilized for trimming sideburns as well as hairs on the underside of the chin due to the inclined condition that the trimmer plane assumes in the operative position.

Accordingly, it is a primary object of the present invention to provide a dry shaver with an improved trimmer which is capable of effecting a close cut easily and comfortably, while retaining the advantages arising from the inclined trimmer plate in the operative position for further increased convenience.

In a preferred embodiment, the main cutter comprises an outer shear foil and an inner blade assembly reciprocating in hair shearing engagement with the inner surface with the outer shear foil. The outer shear foil is curved to have an apex which is offset toward the front face so as to make the main cutter inclined forwardly at substantially the same angle as the trimmer plate in the inclined condition, while the apex is located above the trimmer cutter in the operative position. With this configuration, it is possible to reduce a projecting amount of the main cutter in the direction opposite of the trimmer, while leaving a sufficient clearance between the main cutter and the trimmer cutter in the inclined condition. This is advantageous in that, during the operation of trimming the hairs on the underside of the chin by the trimmer cutter, the main cutter can be kept away from the throat so that the main cutter will not hamper the trimming operation, and in that the main cutter spaced by the sufficient clearance from the main cutter will not be a hindrance to the operation of trimming the sideburns. Additionally, with the like inclined configuration of the cutter and the trimmer plate relative to the longitudinal axis of the housing, the user can enjoy the shaving and trimming in a like fashion.

It is therefore another object of the present invention to provide an improved dry shaver which is capable of enhancing the convenience of utilizing the main cutter and the trimmer.

The trimmer plate is further provided with a screen which extends between the upper end of the trimmer plate and the corresponding portion of the housing so as to conceal a gap formed between the housing and the trimmer plate in the inclined condition. With the provision of the screen, the clipped hairs can be well prevented from entering the space behind the trimmer plate in the operative position, which is therefore a further object of the present invention.

These and still other objects and advantages of the present invention will become more apparent from the following description of the preferred embodiment when taken in conjunction with the attached drawings.

DETAILED DESCRIPTION OF THE EMBODIMENT

Figure 1:
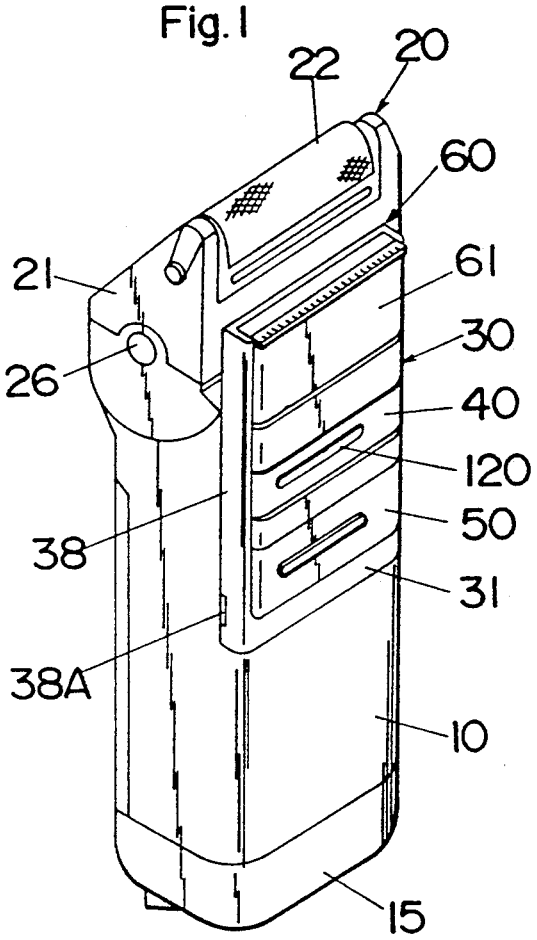
FIGS. 1 and 2 are perspective views of a dry shaver in accordance with a preferred embodiment of the present invention, respectively shown with a trimmer in its lower inoperative position and an upper operative position.
Figure 2:
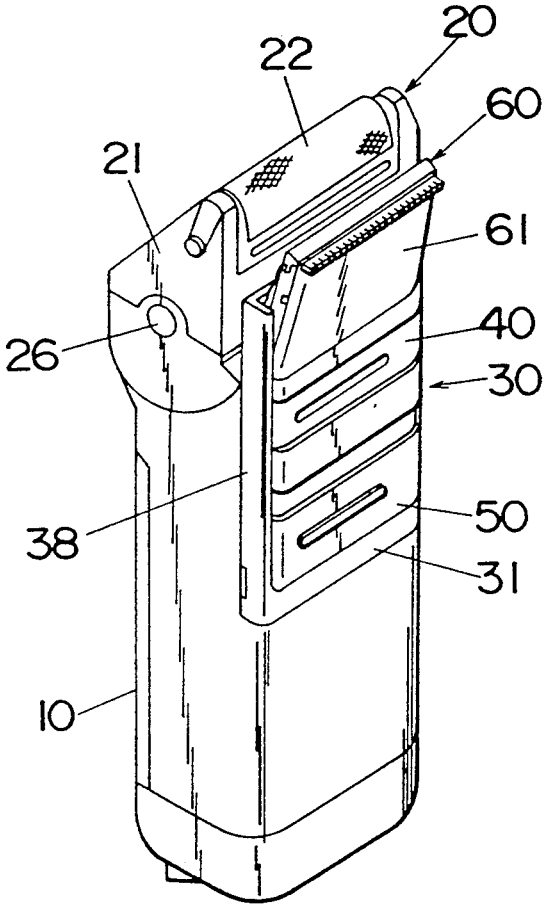
Figure 3:
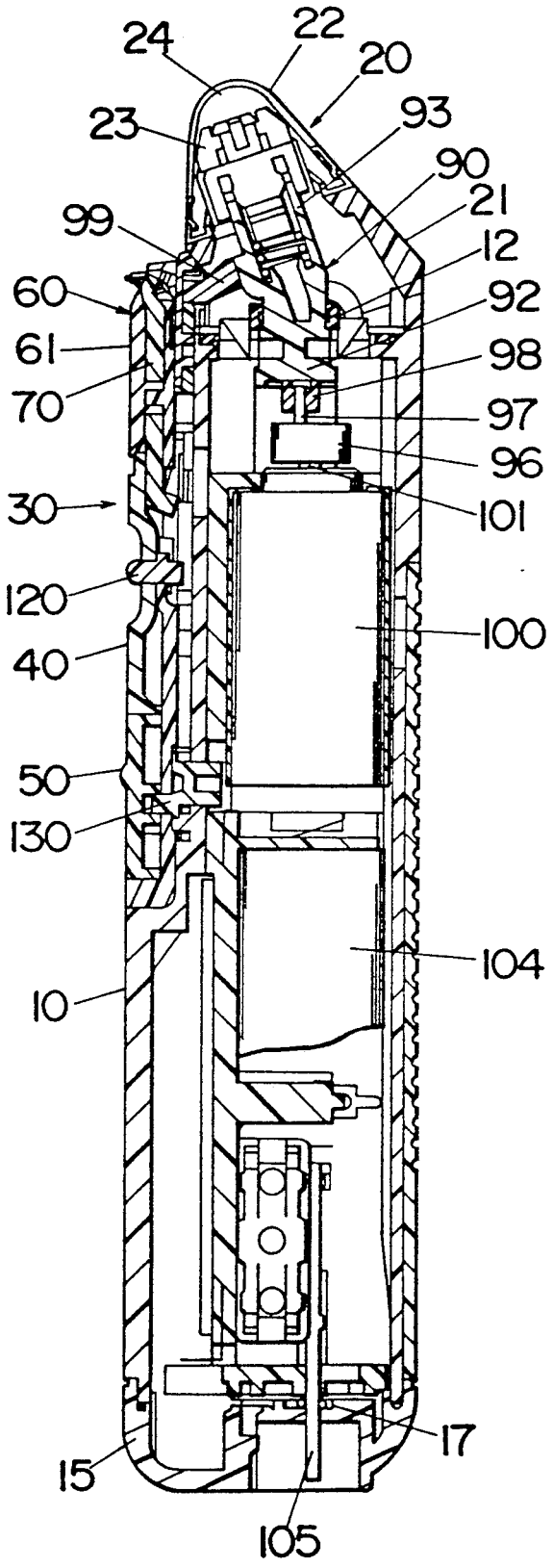
FIG. 3 is a side view in section of the dry shaver.

Referring now to FIGS. 1 to 6, there is shown a dry shaver with a trimmer in accordance with a preferred embodiment of the present invention. The shaver comprises a vertically elongated housing 10 mounting on its top a main cutter 20 and provided on a generally flat front face with a handle unit 50 carrying a main switch handle 40, an auxiliary switch handle 50, and a trimmer unit 60. The main cutter 20 comprises a frame 21 detachably supporting an apertured outer shear foil 22 of a generally V-shaped configuration with a rounded apex. Disposed inside of the frame 21 is an inner blade assembly 23 carrying a number of inner blades 24 which are driven to reciprocated in shearing engagement with the inner surface of the outer shear foil 22. The frame 21 is pivotable about a pivot pin 25 between a closed position of closing upon the inner blade assembly 23 and an open position of exposing the inner blade assembly 23. The frame 21 is locked into the closed position by means of a lock button 26 on the upper side end opposite of the pivot pin 25. The lock button 26, upon being pressed, unlocks the frame 21 so as to pivot it into the open position by a bias of a spring 27 wound around the pivot pin 25. The pivot pin 25 is held on a hinge 28 fixed to the housing 10. As shown in FIG. 3, the apex of the outer shear foil 22 is offset forwardly such that the main cutter 20 is inclined with respect to a vertical plane passing through a center of the housing 10 to have one of the side faces of the outer shear foil 22 extending in a generally parallel relation to the front face of the housing 10.

Figure 6:
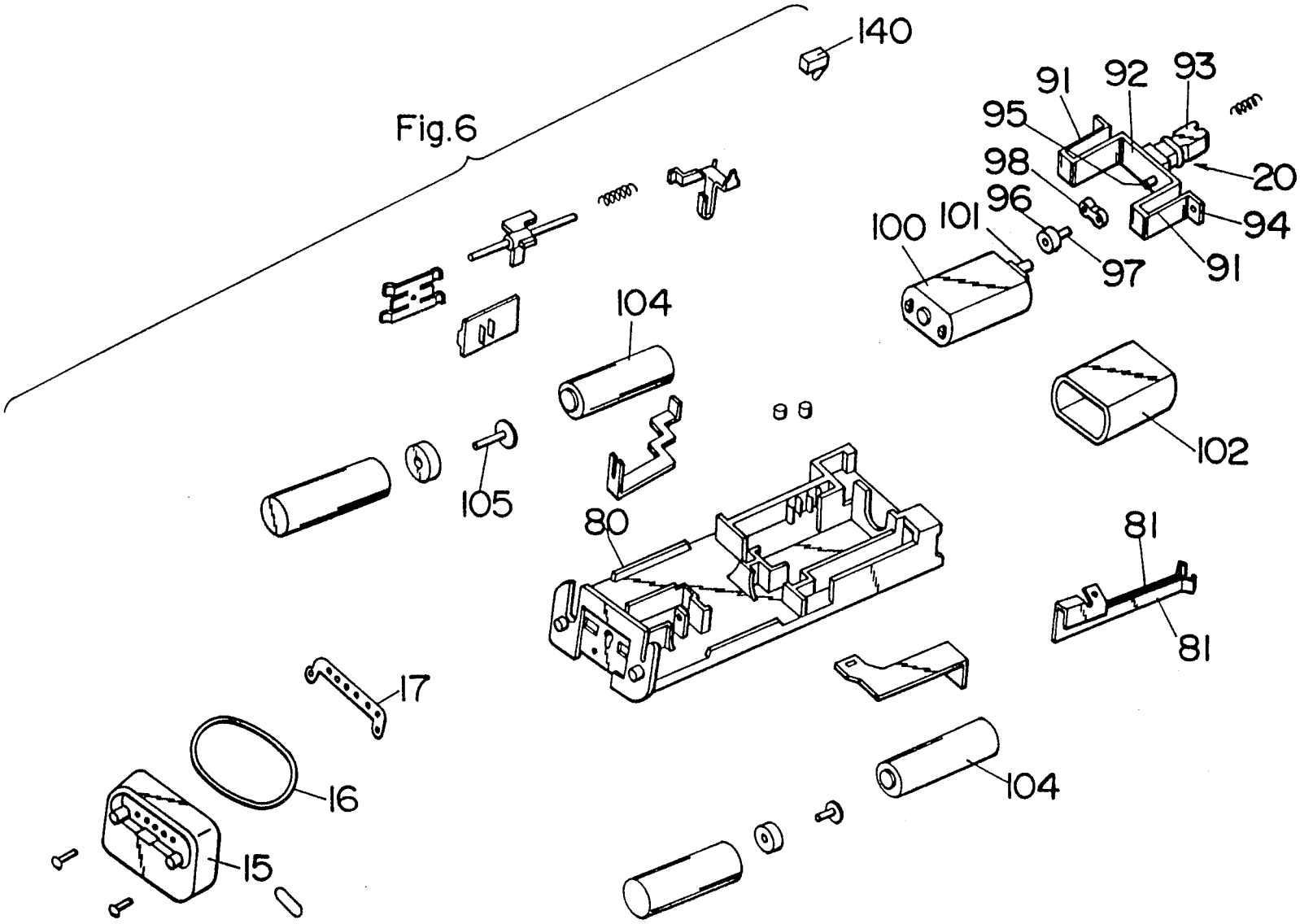
FIG. 6 is an exploded perspective view of an internal unit of the dry shaver.
Figure 7:
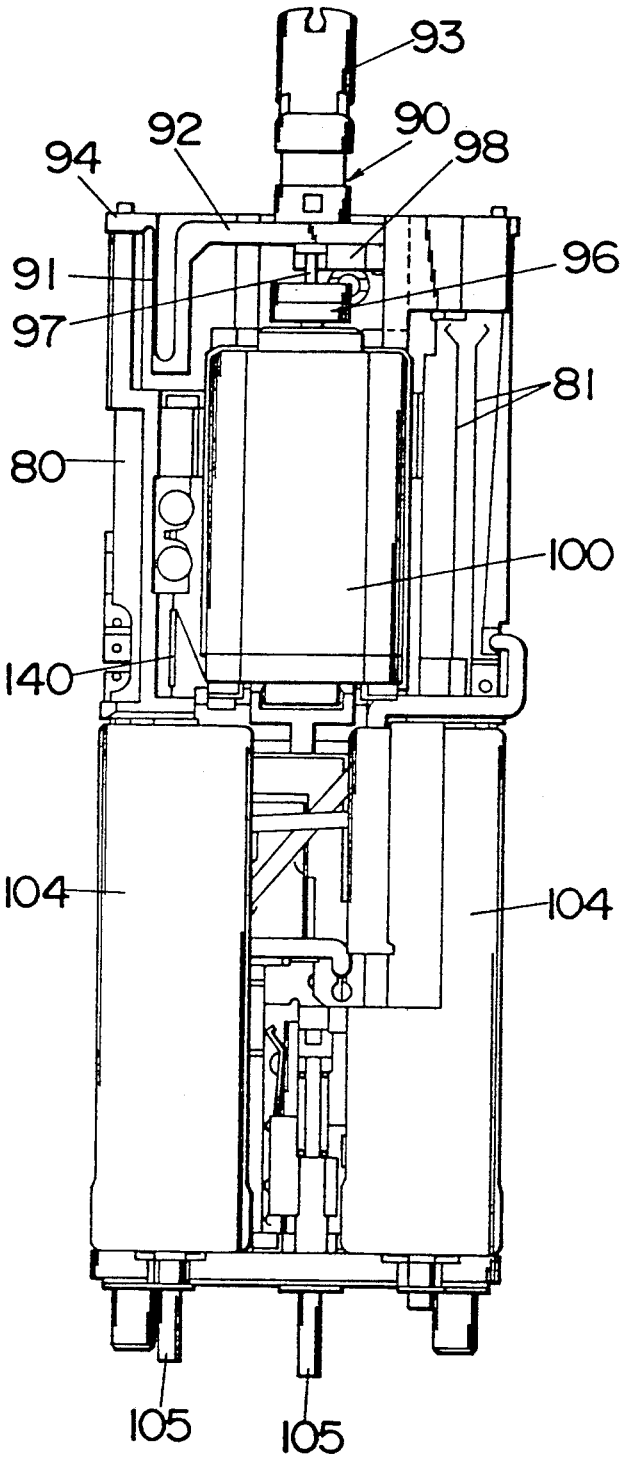
FIG. 7 is a front view of the internal unit.
Figure 8:
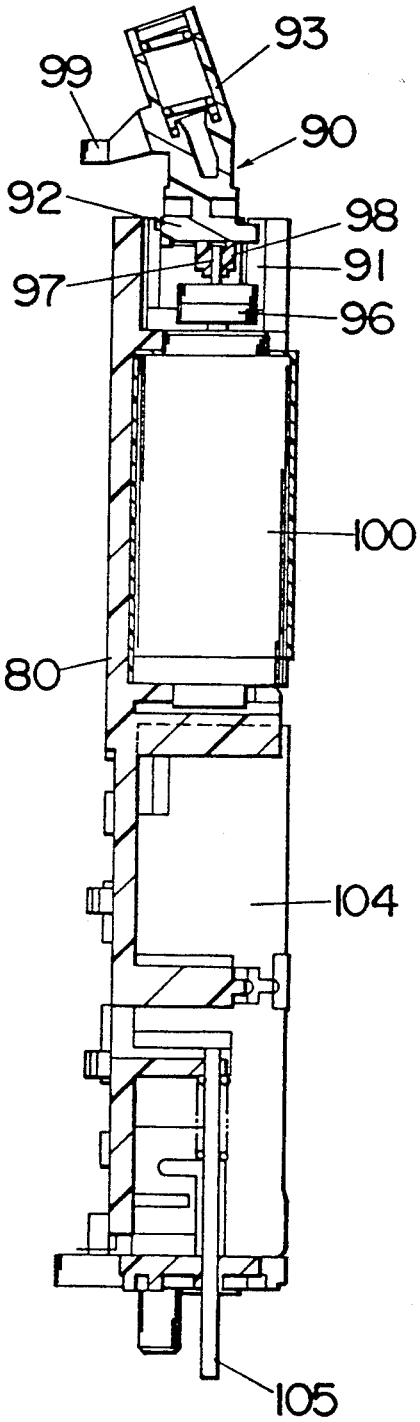
FIG. 8 is a side view partly in section of the internal unit.
Figure 9:
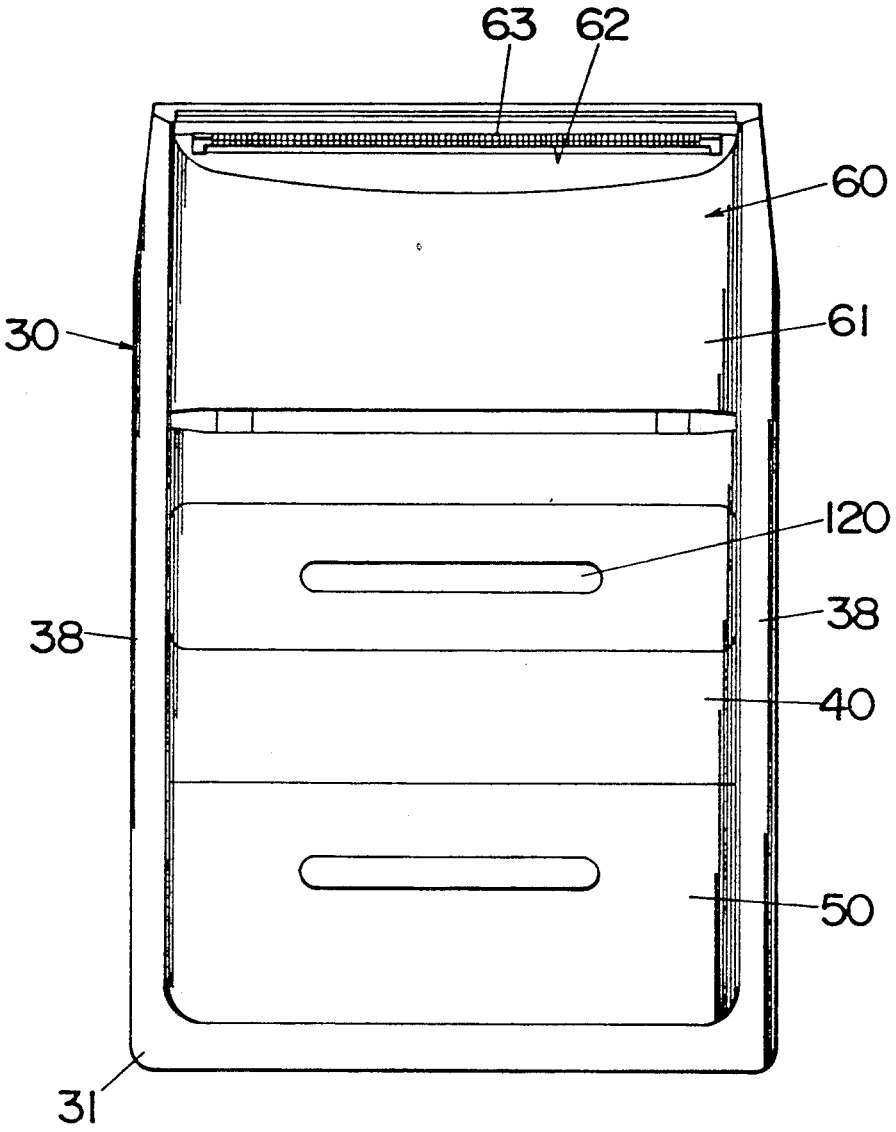
FIGS. 9 and 10 are respectively enlarged front and rear views of a handle unit on the front face of a shaver housing of the dry shaver.

The inner blade assembly 23 is connected to an electric motor 100 through a drive element 90 which translates a rotary movement of a motor output shaft 101 into a reciprocatory movement of the inner blade assembly 23. As shown in FIGS. 6 to 8, the drive element 90 and the motor 100 are supported on a holder 80 together with rechargeable batteries 104 and associated components forming electrical circuits thereof. The drive element 90 has a pair of resilient legs 91 connected by a rigid bar 92 with a joint 93 for coupling with the inner blade assembly 23. The drive element 90 is supported on the holder so with a rigid flange 94 at the upper end of each resilient leg 91 secured to the upper end of the holder 80. The motor output shaft 101 is connected to a cam 96 with an eccentric pin 97 inserted into one end of a lever 98 which is pivoted at the other end to a pin 95 on the underside of the bar 92, so that the eccentric rotary movement of the eccentric pin 97 is converted to a pivotal movement of the lever 98 and is then converted into the reciprocatory movement of the drive element 90 while flexing the resilient legs 91. The motor 100 is surrounded by a tube 102 of vibration-absorbing material. The holder 80 carrying the above components is received through a bottom opening 11 into the housing 10 With the joint 93 extending upwardly through a top wall of the housing 10. A seal 11 is provided to effect water-tight sealing around the joint 93. A bottom plate 15 is fitted to close the bottom opening 11 of the housing 10 With an O-ring 16 disposed therebetween for Water-tight sealing. A terminal seal 17 is also provided to effect water-tight seal for terminal pins 105 projecting outwardly through the bottom plate 15 for electrical connection from a charging circuit of the batteries 104 with an external charger (not shown).

Figure 5:
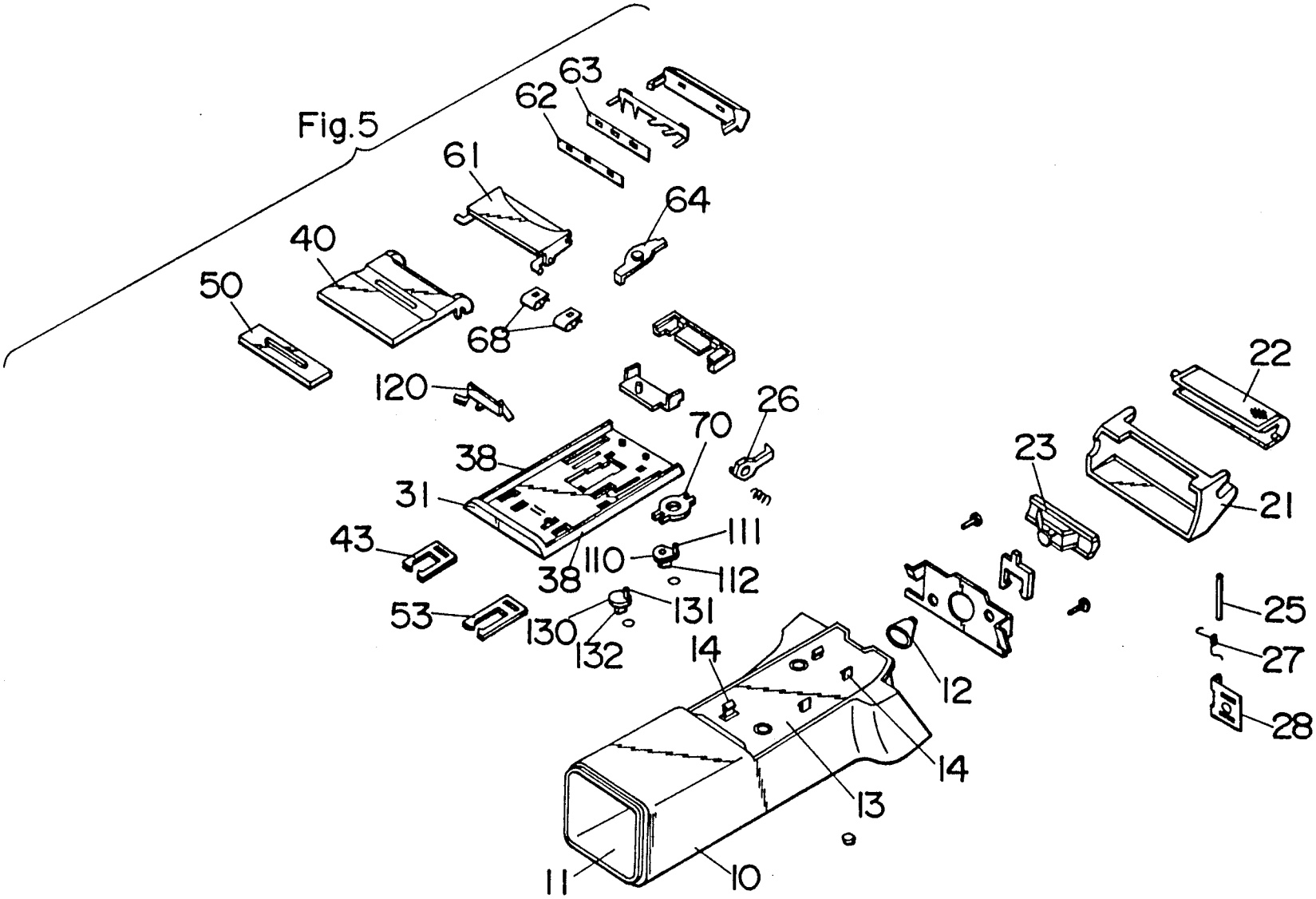
FIG. 5 is an exploded perspective view of the dry shaver.
Figure 10:
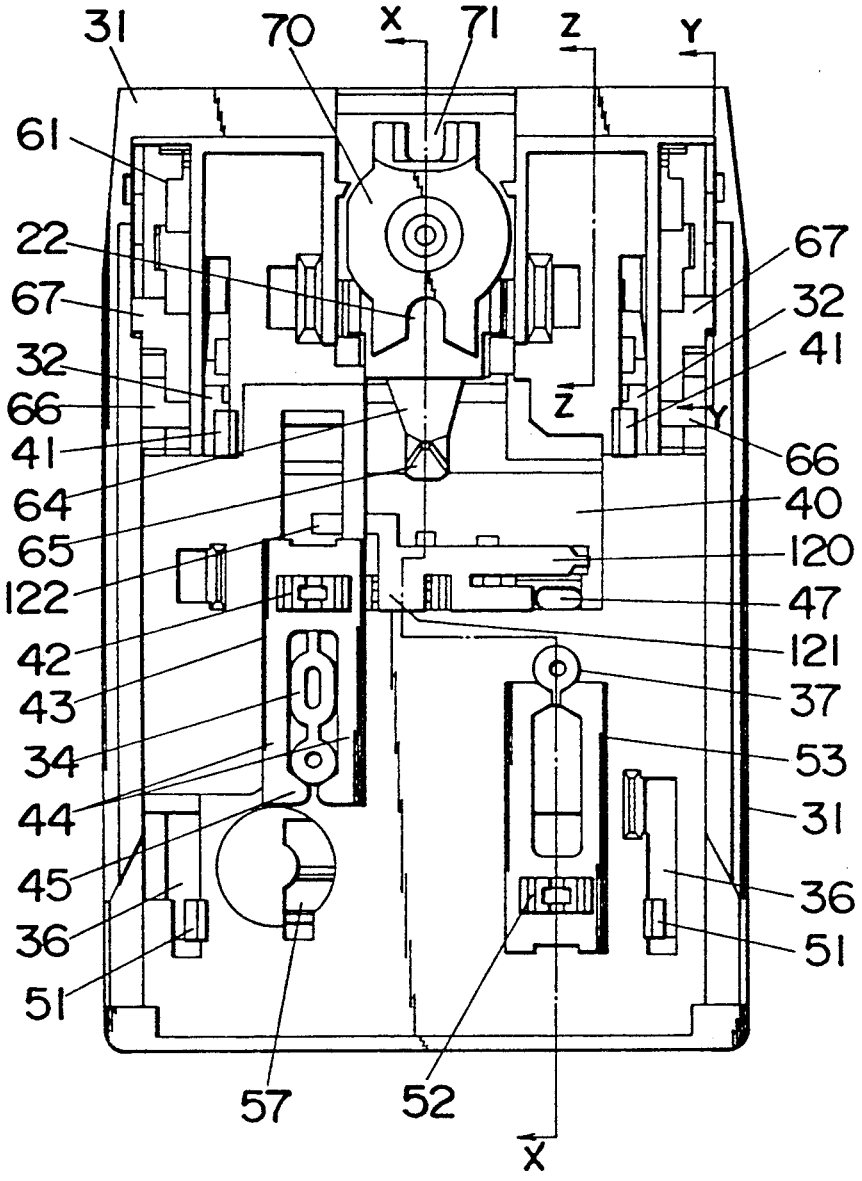
Figure 11:
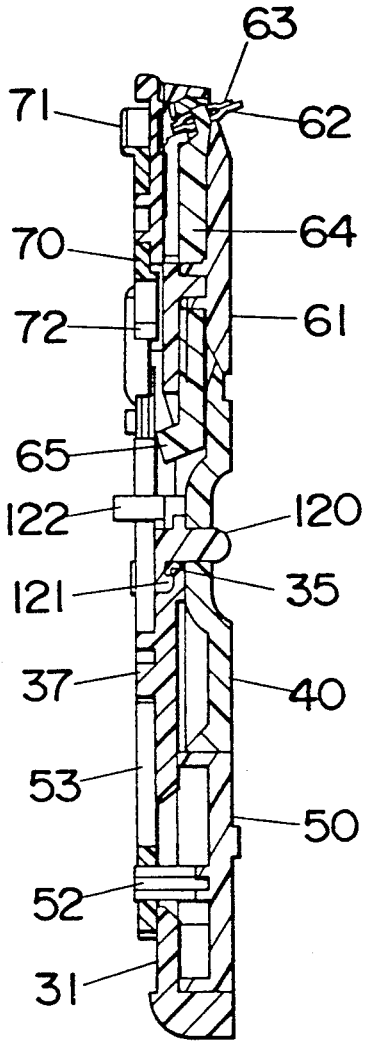
FIG. 11 is a sectional view taken along line X—X of FIG. 10.
Figure 12:
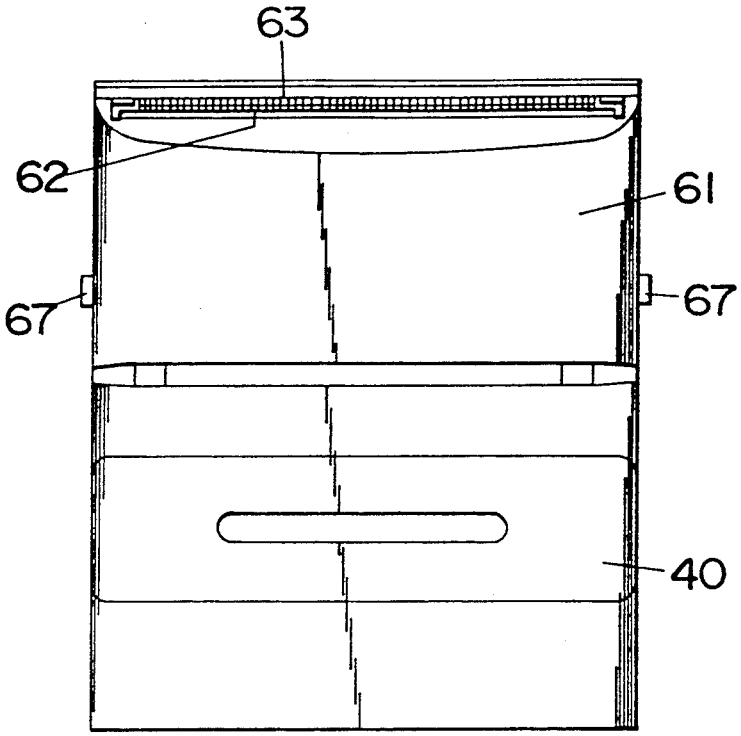
FIGS. 12, 13 and 14 are respectively front, side and rear views of a combination of a switch handle and a trimmer plate of the assembly.

As best shown in FIG. 5, the handle unit 30 comprises a rectangular base plate 31 fitted on a flat recess 13 in the upper half of the front face of the housing 10 and is secured thereto by engagement of integral hooks 14 on the bottom of the recess 13 with corresponding holes in the base plate 31. The base plate 31 has opposed side flanges 38 between which the main switch handle 40, the auxiliary switch 50, and the trimmer unit 60 are received. The main switch handle 40 is slidably held on the base plate 31 by means of a pair of hooks 41 which projects on the rear surface of the handle 40 into engagement with vertically elongated slots 32 in the base plate 31, as shown in FIG. 10. The switch handle 40 is connected through an integral finger 42 to a spring latch 43 slidable on the rear surface of the base plate 31. The spring latch 43 has a pair of resilient arms 44 with inward cam projections 45 at the free ends of the arms 44 for engagement with a vertically spaced pair of latch projections 34 on the rear surface of the base plate 31. As the spring latch 43 moves vertically together with the main switch handle 40 relative to the base plate 31, the resilient arms 44 are caused to flex outwardly each time the cam projections 45 ride over the latch projections 34 and flex inwardly for latching engagement with one of three vertically spaced reduced-in-width sections formed adjacent above the upper projection, between the upper and lower projections, and immediately below the lower projection, as shown in FIG. 10. Thus, the main switch handle 40 is formed as a three-position selector having a lower power-off, a mid power-on position, and a upper trimmer-on position. The switch handle 40 is operatively connected to a pair of spring contacts 81 held on the holder 80 through an actuator 110 pivotally supported on the bottom of the recess 13. The actuator 110 has an offset pin 111 projecting into a slot 47 in the rear surface of the handle 40 and has a cam shaft 112 projecting inwardly into the housing 10 for engagement with the spring contacts 81 such that, when the main switch handle 40 is moved from the lower power-off position to the mid power-on position, the actuator 110 is caused to pivot to thereby rotate the cam shaft 112 for make electrical conduction between the spring contacts 81, thereby energizing the motor 100 to reciprocate the drive element 90, i.e., the inner blade assembly 23. At the upper trimmer-on position of the handle 40, the spring contacts 81 are kept conductive for continued energization of the motor 100. The switch handle 40 carries a lock button 120 extending onto the front face of the handle 40 with a projection 121 engaged with a corresponding dent 35 in the rear surface of the base plate 31, as shown in FIG. 11, for locking the handle 40 in the lower power-off position. Integral spring legs 122 projecting rearwardly from the lock button 120 abut against the bottom of the recess 13 to bias the lock button 120 in the direction of keeping the locking engagement of the projection 121 with the dent 35. The handle 40 is unlocked simply by pressing the lock button 120 and is allowed to move into the mid power-on position and further into the upper trimmer-on position.

Figure 4:
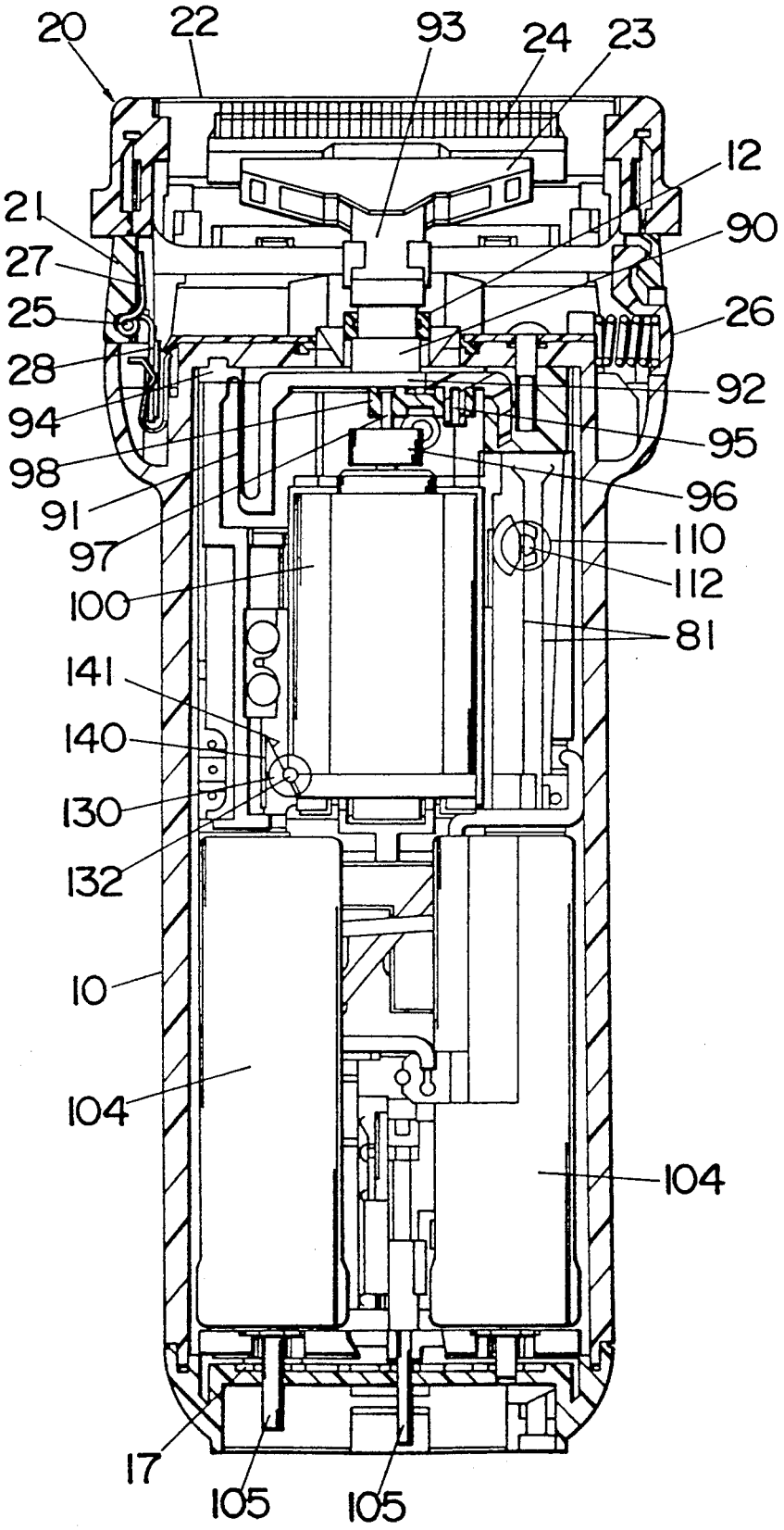
FIG. 4 is a rear view in section of the dry shaver.

The auxiliary switch handle 50 is provided to energize the motor 100 by an auxiliary one of the batteries 104 when the Other main battery 104 is exhausted. In this connection, the auxiliary switch handle 50 is provided below the main switch handle 40 and is only allowed to move upwardly into an ON-position when the main switch handle 40 is in the power-on position or in the trimmer-on position. As shown in FIG. 10, the auxiliary switch handle 50 is also slidably held on the base plate 31 by means of a pair of hooks 51 which projects on the rear surface of the handle 50 into engagement with vertically elongated slots 36 in the base plate 31. The handle 50 is connected through an integral finger 52 to a spring latch 53 slidable on the rear surface of the base plate 31. The spring latch 53 is cooperative with a latch projection 37 on the rear surface of the base plate 31 in the like manner as in the main switch handle 40 to make the auxiliary switch handle 50 as a two-position selector movable between the upper ON-position and a lower OFF-position. The handle 50 is also connected to an actuator 130 which is pivotally supported on the bottom of the recess 13 with an offset pin 131 engaged into a slot 57 in the rear surface of the handle 50. The actuator 130 has a cam shaft 132 engaged with an actuator lever 141 of a miniature switch 140, as shown in FIG. 4, such that when the handle 50 is moved into the upper ON-position the cam shaft 132 is caused to rotate to turn on the miniature switch 140, thereby energizing the motor 100 from the auxiliary battery. Otherwise, the miniature switch 140 is kept turned off.

Figure 13:
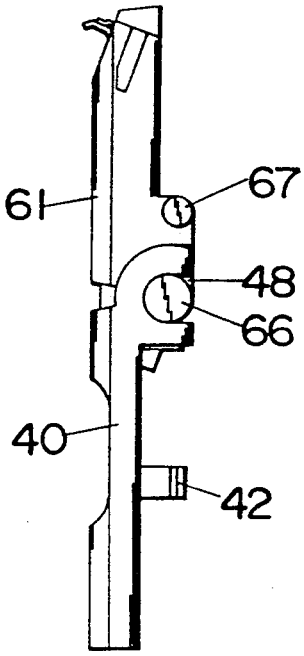
Figure 14:
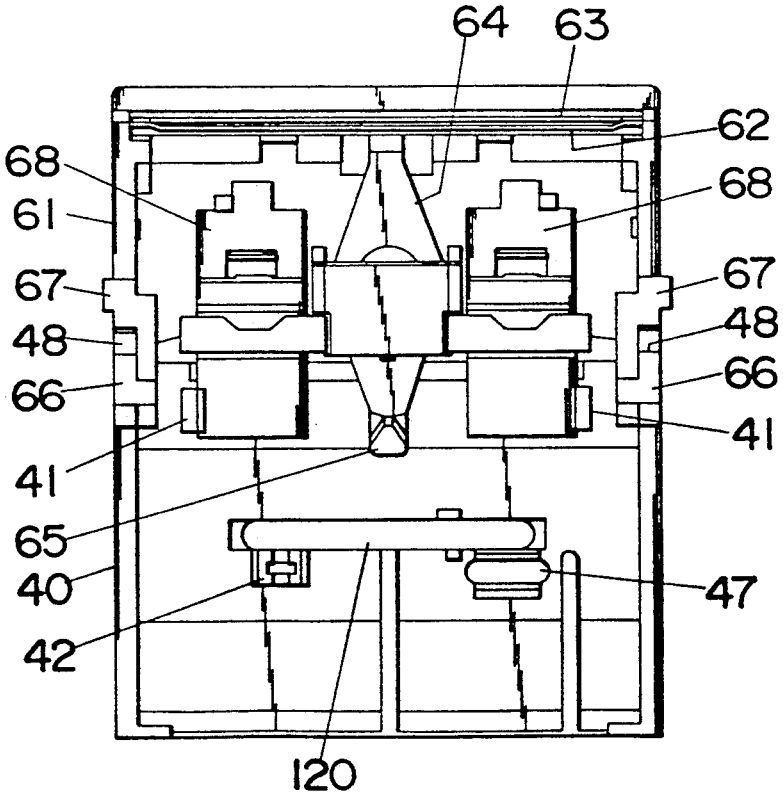

The trimmer unit 60 comprises a trimmer plate 61 carrying a pair of toothed stationary and movable trimmer blades 62 and 63 extending horizontally along the upper end of the trimmer plate 61 and projecting forwardly thereof. The movable blade 63 is superimposed upon the stationary blade 62 at the upper end of the trimmer plate 61 in such a manner as to have the leading edge of the movable blade 63 receded from that of the stationary blade 62 as well as to define therebetween a trimmer cutting plane somewhat inclined with respect to the general vertical plane of the trimmer plate 62, as seen in FIGS. 11 and 13. Pivotally supported on the rear of the trimmer plate 62 is a drive lever 64 which is connected at its upper end to the movable blade 63 and is formed at its lower end with a stud 65, as shown in FIG. 14, for connection with the drive element 90 through a cradle lever 70 pivotally supported on the rear of the base plate 31, as shown in FIG. 10. The cradle lever 70 is provided at its upper end With a socket 71 for constant engagement with a drive arm 99 extending integrally from the drive element 90. Formed at the lower end of the cradle lever 70 is a catch 72 into which the stud 65 of the drive lever 64 is engaged when the trimmer plate 61 is moved upwardly relative to the base plate 31 to thereby establish the driving connection from the drive element 90 to the movable blade 63 for reciprocation thereof.

Figure 15A:
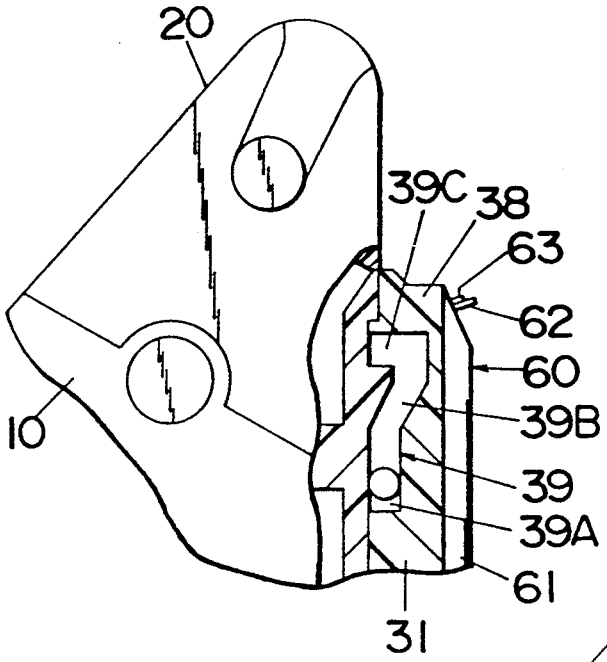
FIGS. 15A to 15C illustrate the trimmer plate, shown in section corresponding to line Y—Y of FIG. 10, respectively in the power-off position, the power-on position, and the trimmer-on position.
Figure 15B:
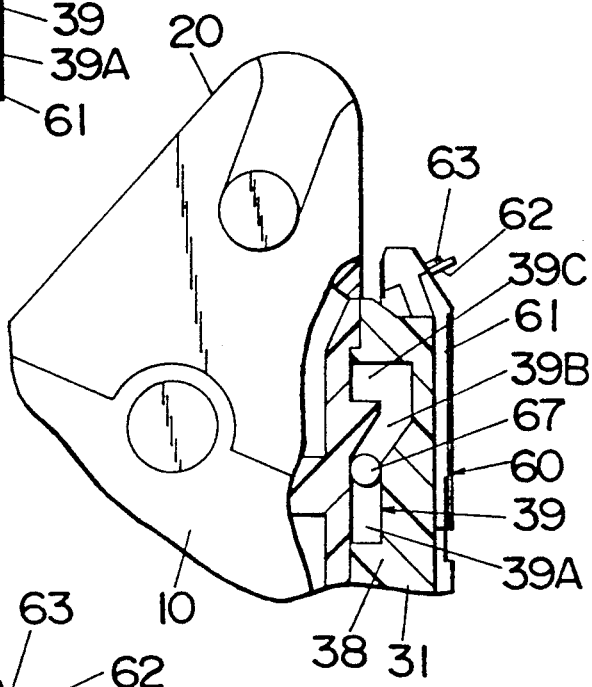
Figure 15C:
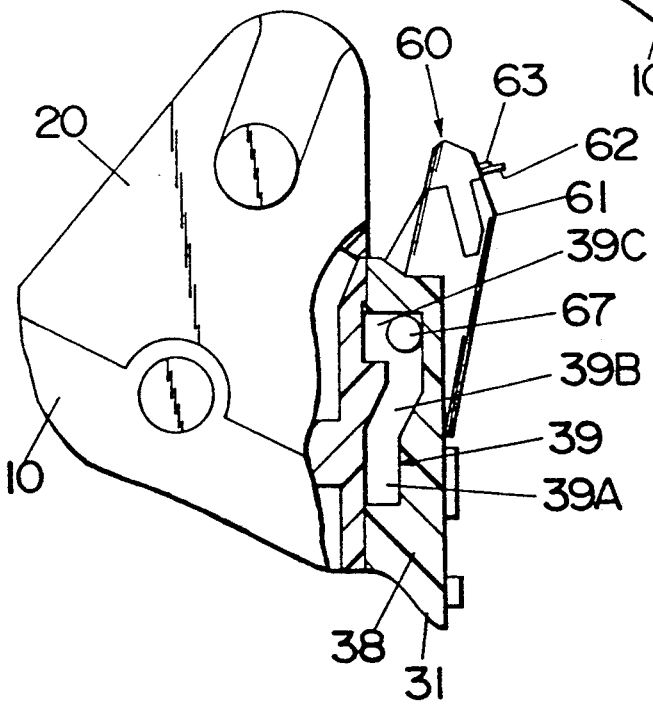
Figure 16A:
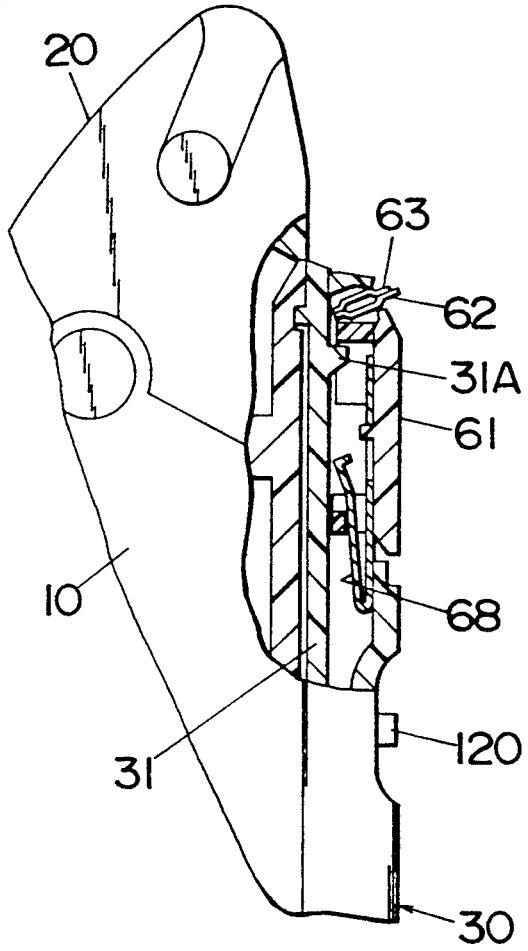
FIGS. 16A to 16C illustrate the switch handle and the trimmer plate, respectively in an power-off position, a power-on position, and a trimmer-on position, with the trimmer plate shown in section corresponding to line Z—Z of FIG. 10.
Figure 16B:
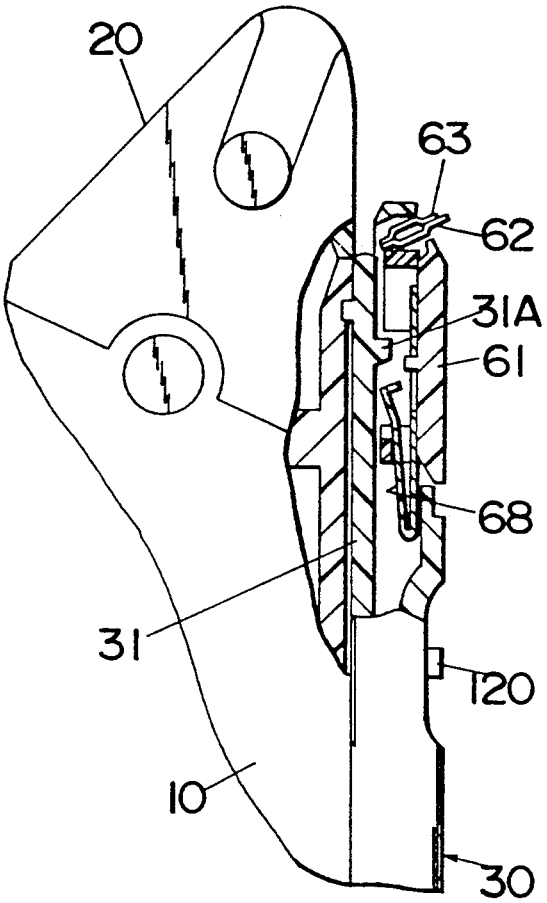
Figure 16C:
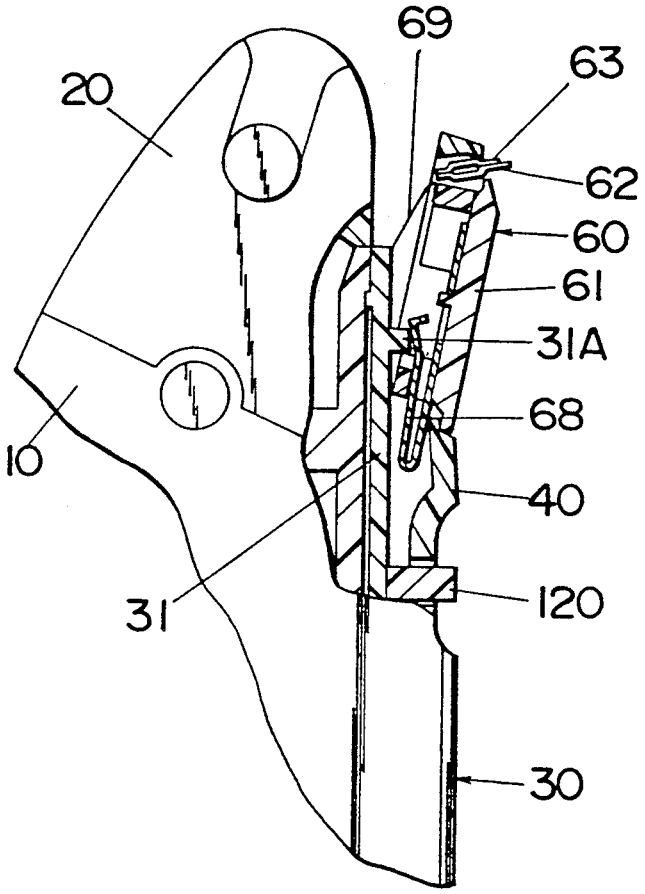
Figure 17:
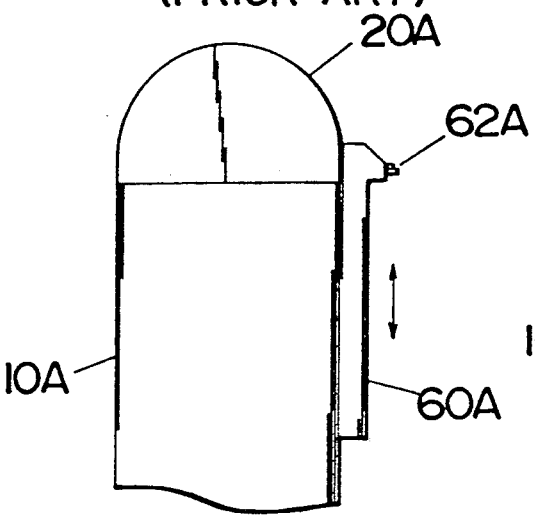
Fig.17 (PRIOR ART)
FIGS. 17 and 18 are respectively schematic views illustrating typical prior art dry shavers with a trimmer.
Figure 18:
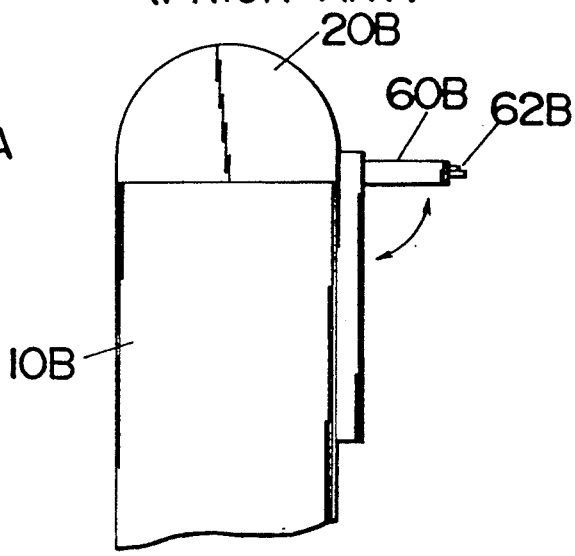
Fig.18 (PRIOR ART)
Figure 19:
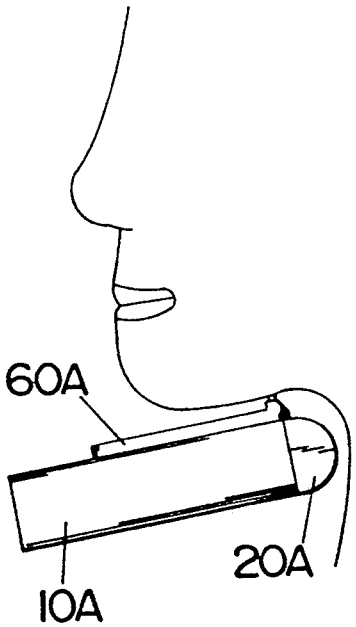
Fig.19 (PRIOR ART)
FIGS. 19 and 20 are respectively schematic views illustrating the operations of the prior dry shavers of FIGS. 17 and 18, respectively.
Figure 20:
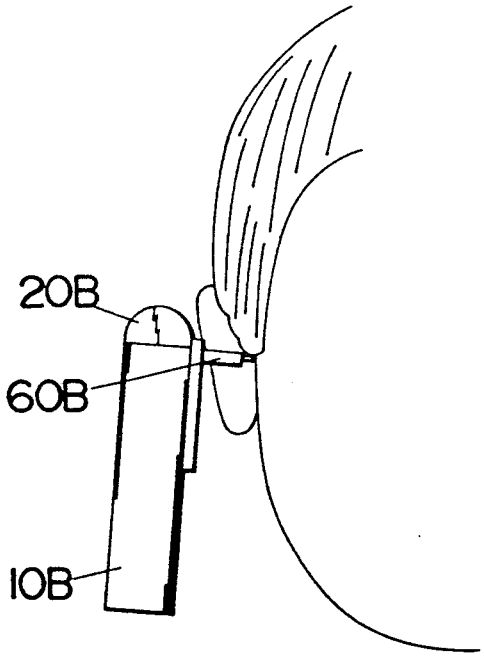
Fig.20 (PRIOR ART)

As shown in FIGS. 13 and 14, the trimmer plate 61 is provided at its lower end with a pair of side pins 66 which are received respectively in bearing sockets 48 at the upper end of the main switch handle 40. Thus, the trimmer plate 61 is pivotally connected at its lower end to the upper end of the main switch handle 40 so that it is vertically movable together therewith and pivotable relative thereto. A pair of guide pins 67 project from the trimmer plate 61 upwardly of the side pins 66 for sliding engagement into corresponding guide slots 39 formed in opposed side flanges 38, as shown in FIGS. 15A to 15C. The guide slots 39 are each of figure 7-shaped configuration with a lower vertical channel 39A, a forwardly inclined channel 39B extending upwardly from the lower vertical channel 39A, and an upper horizontal channel 39C extending backward from the upper end of the inclined segment 39B. When the main switch handle 40 is in the lower off-position or moved upwardly into the mid power-on position, as respectively shown in FIGS. 15A and 15B, the guide pin 67 is retained in the vertical channel 39A so that the trimmer plate 61 is kept in parallel with the main switch handle 40, at which condition the stud 65 of the drive lever 64 is kept disengaged from the catch 72 of the cradle lever 70 to thereby keep the movable blade 63 inoperative. When the main switch handle 40 is moved further upwardly into the trimmer-on position, as shown in FIG. 15C, the guide pin 67 is guided through the inclined channel 39B to thereby pivot the trimmer plate 61 forwardly, at which condition this condition the stud 65 of the drive lever 64 comes into engagement with the catch 72 of the cradle lever 70 to reciprocate the movable blade 63, thus enabling the trimmer operation at the forwardly projecting trimmer blades 62 and 63. It is noted here that the trimmer plate 61 is urged forwardly by springs 68 into the inclined position of FIGS. 15C and 16C. With the provision of the horizontal channel 390 at the upper end of the guide slot 39, the guide pin 67 is allowed to move rearward against the bias of the springs 68 to thereby pivot the trimmer plate 61 correspondingly rearward from the inclined position of FIGS. 15C and 16C. Thus, the spring bias can give a suitable contact pressure at which the trimmer cutter edge is pressed against the skin of the user, enabling the trimmer cutter edge to be held into constant and intimate contact with the skin for smoothly and easily cutting the hair, particularly at irregular skin surfaces. It should be noted in this connection that since the stationary trimmer blade 62 is urged into pressed contact with the skin ahead of the movable blade 63, the skin is not irritated or injured by the movable blade 63. The springs 68 are each of a generally U-shaped configuration and carried on the rear of the trimmer plate 61 with one leg of U-shape secured thereto. The other leg of the spring 68 is left free when the main switch handle 40 is in the power-off position of FIG. 16A or in the power-on position of FIG. 16B so that the spring 68 does not give the spring bias to the trimmer plate 61. When the switch handle 40 is moved upwardly into the trimmer-on position, the other leg of the spring 68 comes into engagement with a projection 31A where the spring 68 is compressed, as shown in FIG. 16C, to thereby urge the trimmer plate 61 forwardly into the inclined condition. As seen in the figure, the trimmer plate 61 in the inclined condition is angled at substantially equal extent to the inclined main cutter 20 with the trimmer cutter positioned below the apex of the main cutter 20, and is retractable towards the one side of the main cutter 20 from that position.

A screen 69 of flexible sheet is provided between the upper end of the trimmer plate 61 and the upper end of the base plate 31 so that it expands over a gap formed between the trimmer plate 61 and the base plate 31 when the trimmer plate 61 is in the inclined condition to prevent the entry of the clipped hairs into between the trimmer plate 61 and the base plate 31. Otherwise, the screen 69 is folded therebetween. The handle unit 30 thus supporting the main switch handle 40, the auxiliary switch handle 50, and the trimmer unit 60 on the base plate 31 is provided as one integral assembly which is readily attached into the recess 13 of the front face of the housing 10. The cradle lever 70 of the trimmer unit 60 is linked to the drive arm 99 of the drive element 90 which extends into the recess 13 upwardly of the top wall of the housing 10, as shown in FIG. 3. Therefore, the handle unit 30 is linked to the internal structure within the housing 10 only through the actuators 110 and 130 which are water-tight sealed, thereby keeping the interior of the housing 10 water-tight and enabling the use of the shaver in the wet condition as in the bath. The base plate 31 is formed in the respective lower ends thereof with drain holes 38A for draining the water entering between the base plate 31 and the recess 13 of the housing 10.

What is claimed is:

1. In a dry shaver with a trimmer comprising:

a housing mounting a main cutter at its upper end and having a vertically elongated front face;

a slide handle slidably mounted on said front face of the housing;

a trimmer plate carrying a trimmer cutter projecting forwardly from an upper end of said trimmer plate, said trimmer plate pivotally coupled at its lower end to said slide handle such that said trimmer plate is vertically movable together therewith on said front face between a lower inoperative position where it is kept lain flat against said front face and an upper operative position where it is pivoted into an inclined condition with respect to said front face so as to project said trimmer cutter forwardly of said front face by a greater distance from said front face than at said lower inoperative position;

said trimmer plate is characterized to be capable of moving toward said front face when it is in said upper operative position and is spring-biased toward into said inclined condition such that said trimmer plate is allowed to pivot toward said front face against the spring bias.

2. A dry shaver as set forth in claim 1, wherein said main cutter comprises an outer shear foil and an inner blade assembly reciprocating in hair shearing engagement with the inner surface with said outer shear foil, said outer shear foil being arcuately curved to have an apex which is offset toward said front face to make said main cutter inclined forwardly at substantially the same angle as said trimmer plate in said inclined condition, said apex being located above said trimmer cutter in said operative position.

3. A dry shaver as set forth in claim 1, wherein said trimmer plate is pivotally supported at its lower end to the upper end of said slide handle to be pivotally about a pivot axis, said trimmer plate provided on its sides adjacent said axis with guide pins for slidable engagement into corresponding slots formed on the side of said housing, said slots being vertically elongated to guide said trimmer plate vertically along said front face, and the upper ends of said slots being inclined forwardly so as to pivot said trimmer plate into said inclined condition as said trimmer plate moves upward into said operative position.

4. A dry shaver as set forth in claim 1, further including a screen which extends between the upper end of said trimmer plate and the corresponding portion of said housing so as to conceal a gap formed between said housing and said trimmer plate in said inclined condition.

5. A dry shaver as set forth in claim 1, wherein said trimmer plate carries at least one U-shaped spring with a pair of spring legs, one of said spring legs being fixed to the trimmer plate with the other spring leg extending in an engageable relation with a corresponding projection on the side of said housing such that, when said trimmer plate is moved into said operative position, said other spring leg comes engaged with said projection to compress said U-shaped spring for biasing said trimmer plate forwardly.

* * * * *